US006585485B2

(12) United States Patent
Lee et al.

(10) Patent No.: US 6,585,485 B2
(45) Date of Patent: Jul. 1, 2003

(54) AIR FLOW GUIDE DEVICE ON HEAT DISPENSING FAN

(76) Inventors: Sen-Yung Lee, 9F, No. 84, Section 3, Chang-Rong Road, Tainan City (TW); Shueei-Muh Lin, No. 17, Lane 99, Ming-Shin Road, Tainan City (TW); Hsin-Mao Hsieh, No. 6, East Section, Industrial Sixth Road, Pin-Tong City (TW)

( * ) Notice: Subject to any disclaimer, the term of this patent is extended or adjusted under 35 U.S.C. 154(b) by 85 days.

(21) Appl. No.: 09/862,330

(22) Filed: May 23, 2001

(65) Prior Publication Data

US 2002/0176775 A1 Nov. 28, 2002

(51) Int. Cl.[7] ..... F04D 29/44

(52) U.S. Cl. ..... 415/203; 415/176; 415/211.2; 415/226

(58) Field of Search ..... 415/226, 203, 415/211.2, 176; 361/694, 695, 696, 697, 688, 687

(56) References Cited

U.S. PATENT DOCUMENTS 6,049,455 A * 4/2000 Nakamura et al. ..... 361/694
6,122,168 A * 9/2000 Cheng ..... 361/694
6,343,011 B1 * 1/2002 Yu ..... 361/695

* cited by examiner

*Primary Examiner*—Edward K. Look
*Assistant Examiner*—Igor Kershteyn
(74) *Attorney, Agent, or Firm*—Rosenberg, Klein & Lee

(57) ABSTRACT

An air flow guide device for mounting on a heat dispensing fan includes a U-shaped frame and each of the three sides of the frame has a curve outer surface. A plate is connected between two distal ends of the frame and extends inclinedly from a top edge of the two distal ends of the frame, and a slot is defined between the two distal ends of the frame and the plate. Air flow smoothly flows over the curve smooth surfaces and is sucked by the fan. The plate prevents the exhausted air from being sucked by the fan.

1 Claim, 5 Drawing Sheets

AIR FLOW GUIDE DEVICE ON HEAT DISPENSING FAN

FIELD OF THE INVENTION

The present invention relates to an air flow guide device mounted to a computer heat dispensing fan and includes three smooth surfaces to guide the air flows and a plate to prevent the exhausted air from being re-sucked in the fan.

BACKGROUND OF THE INVENTION

A conventional heat dispensing fan for use in notebook computer is shown in FIGS. 1 and 2 and generally includes a casing 10 having a fan device 110 received therein and a top hole is defined in a top of the casing 10 so as to suck air therethrough. A side hole 120 is defined in one of four sides of the casing 10 so that the heat air is exhausted from the side hole 120. However, because the casing 10 has vertical four sides so that when the heat dispensing fan is installed in an air path 200 in the computer, the vertical walls are located at an right angle to the surface in the air path 200 and air flow could be stopped by the walls and there reducing the efficiency of the heat dispensing fan. In addition, the exhausted air released from the side hole 120 could be re-sucked again by the fan 110 and the air flow sucked into the casing will bounce back at the inside of the three closed walls so that the sucking force of the is reduced.

SUMMARY OF THE INVENTION

In accordance with one aspect of the present invention, there is provided an air flow guide device for mounting on a heat dispensing fan which includes a casing with a fan received therein and having a top hole and a side hole. The air flow guide device includes a U-shaped frame and each of the three sides of the frame had a curve outer surface. A plate is connected between two distal ends of the frame and extends inclinedly from a top edge of the two distal ends of the frame. A slot is defined between the two distal ends of the frame and the plate.

The primary object of the present invention is to provide a air flow guide device for mounting on the heat dispensing fan in computers wherein a plate extending from the guide device effectively prevents the exhausted air from being sucked by the fan again.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
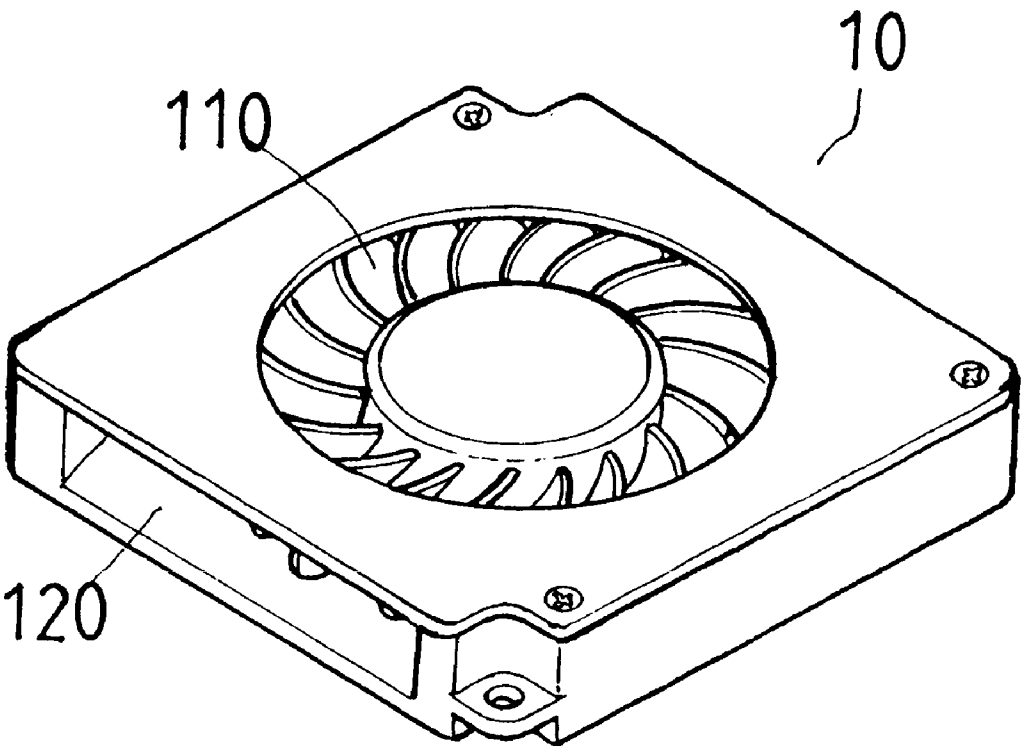
FIG.1 PRIOR ART
FIG. 1 is a perspective view to show a conventional heat dispensing fan.
Figure 2:
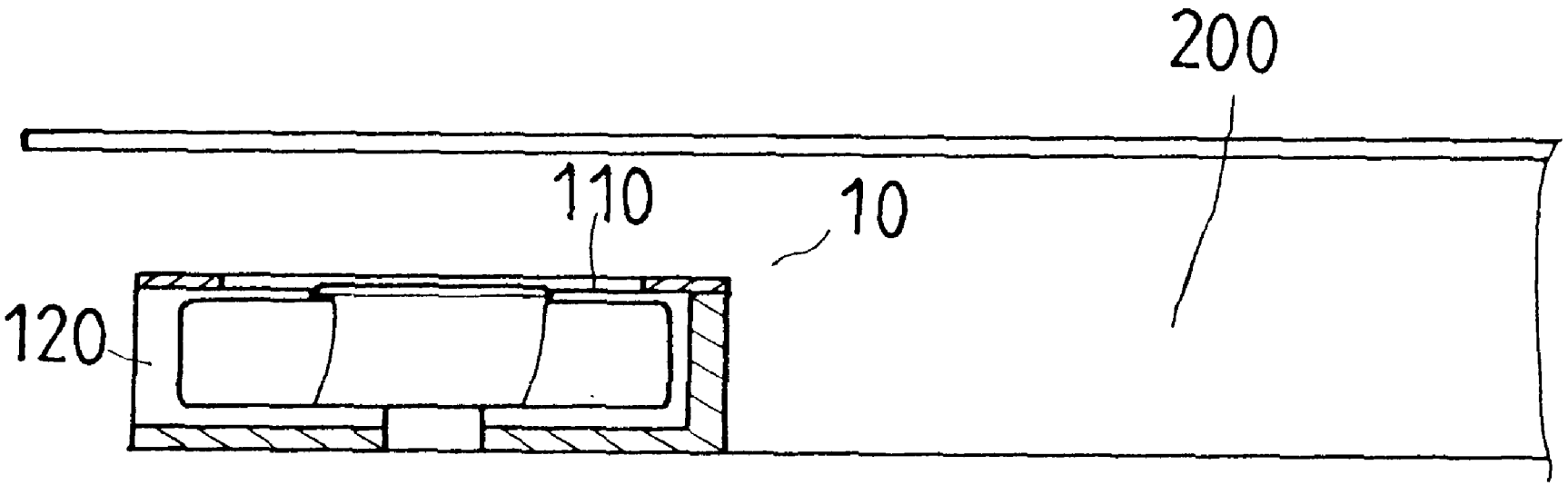
FIG.2 PRIOR ART
FIG. 2 is a cross sectional view to show the conventional heat dispensing fan is installed in an air path in a computer.
Figure 3:
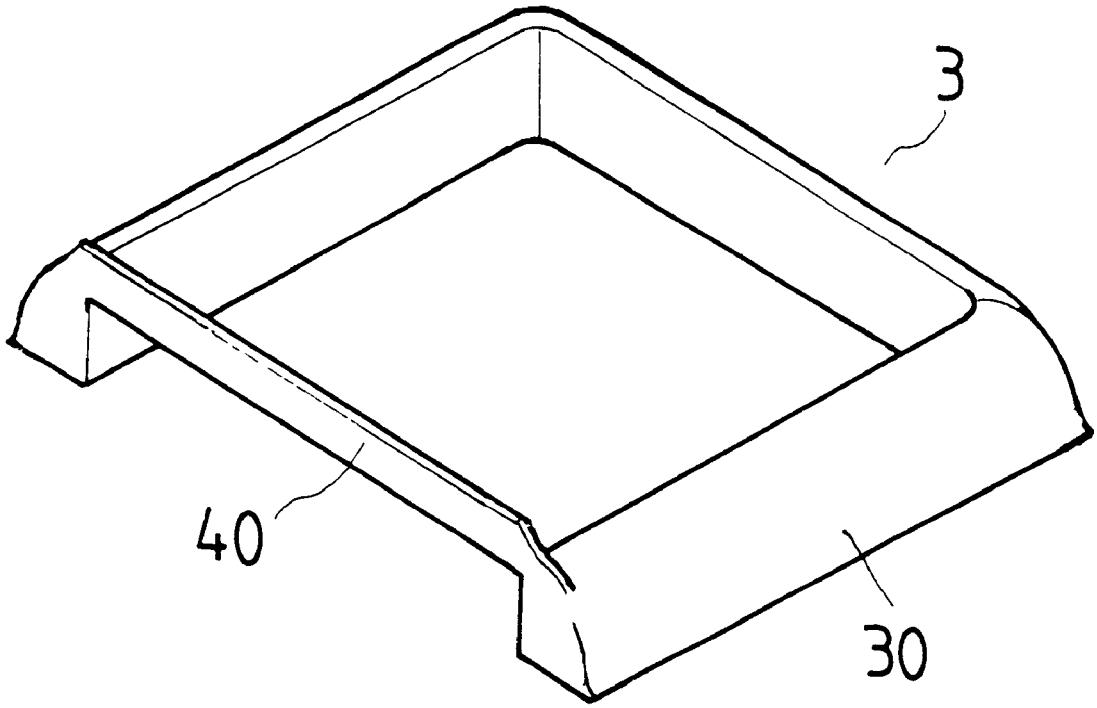
FIG. 3 is a perspective view to show a air flow guide device of the present invention.
Figure 4:
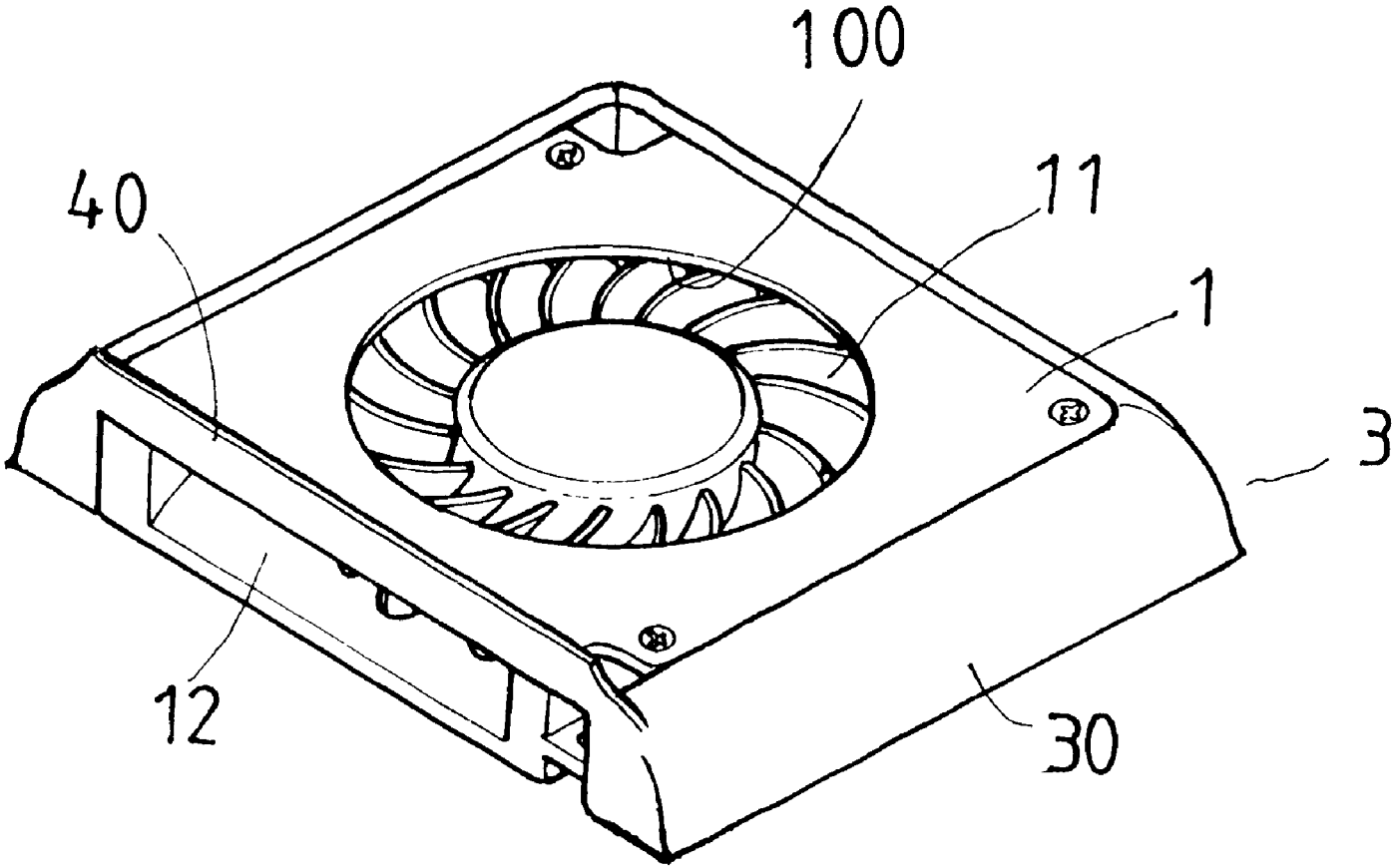
FIG. 4 is a perspective view to show that the air flow guide device of the present invention is mounted to a heat dispensing fan.

Referring to FIGS. 3 and 4, the air flow guide device of the present invention comprises a U-shaped frame 3 which is made of rubber and each of the three sides of the frame 3 has a curve outer surface 30. A plate 40 is connected between two distal ends of the frame 3 and extends inclinedly from a top edge of the two distal ends of the frame 3. A slot 400 is defined between the two distal ends of the frame 3 and the plate 40. The frame 3 is mounted to a heat dispensing fan 1 which includes a rectangular casing with a fan 11 received therein. The casing has a top hole 100 for sucking air therethrough, and a side hole 12 from which the air is released.

Figure 5:
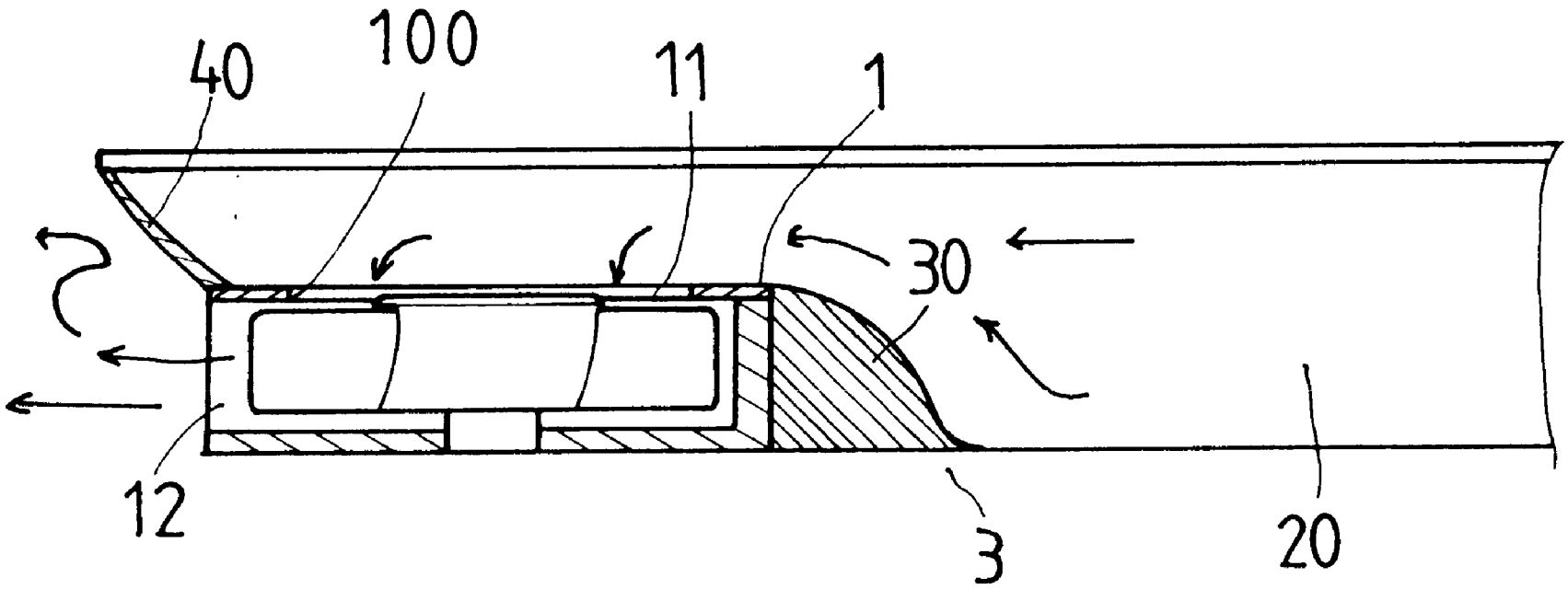
FIG. 5 is a cross sectional view to show the heat dispensing fan with the air flow guide device mounted thereto are installed in an air path in a computer.

As shown in FIG. 5, when the frame 3 is mounted to the heat dispensing device 1 and the combination of these two items are installed in an air path 20 in a computer, air flow goes smoothly over the curve outer surfaces 30 of the frame 3 and is sucked by the fan 11 via the top hole 100. A top edge of the plate 40 contacts an inside of the air path 20 so that the air released from the side hole 12 cannot be sucked by the fan 11. The plate 40 reduces the turbulence of air flow sucked by the fan 11 such that the volume of the air is steadily sucked by the fan 11.

While we have shown and described the embodiment in accordance with the present invention, it should be clear to those skilled in the art that further embodiments may be made without departing from the scope of the present invention.

What is claimed is:

1. An air flow guide device for mounting on a heat dispensing fan which includes a casing with a fan received therein, said casing having a top hole and a side hole, said air flow guide device comprising:

a U-shaped frame and each of three sides of said frame having a curved outer surface with respect to an axis of the fan, a plate connected between two distal ends of said frame and extending inclinedly from a top edge of said two distal ends of said frame, a slot defined between said two distal ends of said frame and said plate.

* * * * *